United States Patent [19]

Hickory

[11] Patent Number: 4,475,926

[45] Date of Patent: Oct. 9, 1984

[54] ACTIVE FILLER FOR GRINDING WHEELS

[75] Inventor: Gordon E. Hickory, Upton, Mass.

[73] Assignee: Norton Company, Worcester, Mass.

[21] Appl. No.: 529,076

[22] Filed: Sep. 2, 1983

Related U.S. Application Data

[63] Continuation-in-part of Ser. No. 352,290, Feb. 25, 1982, abandoned.

[51] Int. Cl.[3] ..... C09K 3/14

[52] U.S. Cl. ..... 51/298; 51/299; 51/300

[58] Field of Search ..... 51/298, 299, 300

[56] References Cited

U.S. PATENT DOCUMENTS

| | | | |
|---|---|---|---|
| 2,216,135 | 10/1940 | Rainer | 51/298 |
| 2,308,981 | 1/1943 | Kistler | 51/295 |
| 2,860,960 | 11/1958 | Gregor | 51/298 |
| 3,246,970 | 4/1966 | Zimmerman | 51/298 |
| 3,524,286 | 8/1970 | Wohrer | 51/298 |
| 4,263,016 | 4/1981 | Hirschberg et al. | 51/309 |
| 4,370,148 | 1/1983 | Hirschberg et al. | 51/293 |

FOREIGN PATENT DOCUMENTS

| | | |
|---|---|---|
| 3026294 | 7/1980 | Fed. Rep. of Germany . |
| 48-23954 | 7/1973 | Japan . |

*Primary Examiner*—James Derrington

*Attorney, Agent, or Firm*—Arthur A. Loiselle, Jr.

[57] ABSTRACT

A resinoid bonded abrasive article in which the resinoid bond includes 5–80% by volume of an improved active filler or grinding aid. The active filler is a mixture of iron pyrites, potassium sulfate and an alkali haloferrate; the alkali haloferrate having the formula $A_x Fe_y{++} Fe_z{+++} H_{x+2y+3z}$ where A is an alkali metal, H is a halogen, x is a number from 1 to 10, y is a number from 0 to 1, z is a number from 0 to 1, and y and z are not zero at the same time. The fillers are present in the bond in a ratio of alkali-haloferrate-to-pyrites-to-potassium sulfate of 0.5:1:0.5.

6 Claims, No Drawings

ACTIVE FILLER FOR GRINDING WHEELS

This is a continuation-in-part of application Ser. No. 06/352,290 filed Feb. 25, 1982, now abandoned.

TECHNICAL FIELD

The invention relates to resinoid or organic polymer bonded abrasive products. More particularly, the invention is concerned with active fillers for grinding wheels and coated abrasives.

BACKGROUND ART

Prior Art Statement

The following patents and publications are representative of the most relevant prior art known to the Applicant at the time of filing the application:

| | | |
|---|---|---|
| | U.S. Patents and Documents | |
| 2,216,135 | October 1, 1940 | E. T. Rainer |
| 2,308,981 | January 19, 1943 | S. S. Kistler |
| 2,860,960 | November 18, 1958 | J. R. Gregor |
| 3,246,970 | April 19, 1966 | R. E. Zimmerman |
| 3,524,286 | April 18, 1970 | L. C. Wohrer |
| 4,263,016 | April 21, 1981 | R. Hirschberg et al |
| | Foreign Patent Documents | |
| 4,823,954 | July, 1983 | Japan |
| 3,026,294 A1 | February 18, 1982 | Fed. Rep. of Germany |

It is known that grinding aids of various types may be used to enhance the cutting efficiency of resin bonded abrasive grain in grinding wheels and coated abrasives. Various combinations of abrasive grain and active filler materials supported together in a resin bond have been suggested for improving the grinding action of abrasive products and certain combinations have been found to be especially useful for grinding and/or cutting ferrous materials.

Resin bonded grinding wheels, including combinations of alumina and other abrasives grains with finely divided fillers such as cryolite, pyrites or $FeS_2$, $KAlF_4$, $K_3AlF_6$, $K_2SO_4$, $PbCl_2$, PbO, $Sb_2S_3$, and mixtures of these materials, are well known and available today. Typical wheels making use of such abrasives and fillers are thin cut-off wheels such as may be used for cutting tubes, bars and other metal objects but other types of resin bonded wheels, such as snagging wheels, are made with abrasives and active fillers.

It has been found that certain combinations of fillers provide a superior grinding quality when used in mixtures. Thus, it has been established that mixtures of $FeS_2$ and $K_2SO_4$ produce a synergistic effect as compared with these same active fillers used alone or in other combinations together in a phenolic bonded cut-off wheel with alumina abrasive.

As pointed out above, fillers which are compounds containing fluorine, chlorine, sulfur, iron, and alkali metals in combinations, are known and widely used.

The Rainier patent discloses sodium chloride, potassium chloride, elemental sulfur, and other alkali metal halides as fillers or grinding aids. Specifically disclosed, in addition to sodium and potassium chlorides, are calcium chloride, calcium bromide, barium chloride, barium bromide, and strontium chloride.

Alkali metal and fluorine containing compounds and iron disulfide are taught by Kistler. Cryolite, sodium fluoroaluminate, is used to advantage in combination with ferrous sulfide, ferric sulfide, ferroferric sulfide or iron disulfide as grinding aids.

The Gregor reference, so far as is relevant to the present invention, suggests the use of sodium fluoroaluminate and iron oxide inter alia, as useful fillers or grinding aids for resinoid bonded grinding wheels.

Still another alkali metal-halogen containing grinding aid is disclosed by Zimmerman viz. potassium fluoroaluminate. The fluorine containing compound is used in conjunction with iron disulfide.

The Wohrer patent advocates the use of numerous fillers, the most relevant of which are sodium fluoroaluminate, sodium chloride, iron disulfide or pyrites as it is most commonly known, potassium sulfate and mixtures of these compounds.

A very effective substitute for the toxic lead and antimony containing fillers which have been used in the past in this country and which still are used in many other countries, is the series of alkali metal chloroferrates taught by the Hirschberg et al citation. These complex salts, according to Hirschberg et al, have the formula $$A_xFe_y++Fe_z+++Cl_{x+2y+3z}$$

where A is an alkali metal ion or ammonium ion, x is a number from 1 to 10, y is a number from zero to 1, z is a number from zero to 1, and y and z cannot be zero at the same time. It is also taught that these compounds are preferably used in conjunction with a basic inorganic compound such as zinc oxide, potassium carbonate or sodium sulfide. Specific alkali metal chloroferrates suggested are $KFeCl_3$, $K_2FeCl_4$, $Na_2FeCl_4$, and $NaK_3FeCl_6$.

In the conventional manner, the Hirschberg et al fillers are incorporated in the bond, e.g. phenol-formaldehyde resin, of a grinding wheel. The substitution in the bond of the Hirschberg et al filler for the usual lead chloride or antimony chloride, does not result in a product with better cutting or grinding characteristics.

It is pointed out by Hirschberg et al in column 3, lines 33–35 that the alkali chloroferrate fillers can be used alone or admixed with other known fillers for grinding wheels.

The German Patent Publication No. 3,026,294 Al is a further variant on the Hirschberg invention; Hirschberg is also the inventor of the subject matter contained in this publication. The German reference discloses the partially fluorinated analogues of U.S. Pat. No. 4,263,016 having the generic formula $$A_xFeCl_yF_z$$

where A is an alkali metal or ammonium ion, x is a number from 1 to 10, y has a value of from 0.1 to 12.9 and the sum of y and z equals at least 3. The use of this material with other known grinding wheel fillers is suggested e.g. pyrites.

The Japanese application No. 4823954 discloses a phenolic resin bonded grinding wheel which incorporates an alkali metal fluoroferrate e.g.. potassium fluoroferrate, as a grinding aid or filler. The presence of the fluoroferrate in the grinding wheel produces a product superior to like products containing cryolite or pyrites.

DISCLOSURE OF THE INVENTION

It has now been discovered that combinations of iron pyrites and potassium sulfate, well known grinding wheel fillers, and an alkali metal chloroferrate or fluoroferrate according to Hirschberg et al e.g. $K_2FeCl_4.2KCl+5\%$ $K_2CO_3$ or $K_2FeCl_3F.2KCl$, $K_2FeCl_3F$ and mixtures of these alkali haloferrates, produce an improved grinding action over combinations of active grinding aids known heretofore. Such combinations of fillers and abrasive grain in a phenolic resin bonded cut-off wheel, referring particularly to the named active fillers, have been found to either reduce the power required for driving the cut-off wheel, or produce less burn as compared with conventional abrasive and known filler mixtures, or cut with a higher grinding ratio.

The haloferrates, according to Hirschberg et al, are formed by fusing a mixture of one or more alkali metal halide, anhydrous ferric chloride, and iron powder; the resulting product is stated to be $A_xFe_y++-Fe_z+++Cl_{x+2y+3z}$ or $A_xFeCl_yF_z$ as defined above, depending on the reagents used, which obviously designate generic chemical compounds. However, upon analysis of the Hirschberg et al fusion products it was found that the fusion products were not simply compounds according to the foregoing formulae, but rather included very substantial amounts of potassium chloride, iron chloride and iron oxides. Therefore, whenever the Hirschberg et al fillers are referred to herein after, it is understood that these other materials may also be present.

As stated above, the invention is the combination of the Hirschberg et al fillers, including the fluorine species, with iron pyrites in combination with potassium sulfate as an active filler in so-called resinoid or organic polymer bonded coated abrasives and grinding wheels. Therefore the invention is independent of the known variables and variations associated with resinoid bonded abrasive products. For example, the invention filler can be utilized with any type of abrasive, e.g. fused alumina, sintered alumina, silicon carbide, garnet, flint, fused alumina-zirconia, diamond, and so-on. Similarly, any polymeric bond may be used, such as simple and modified phenol-formaldehyde resins, epoxy resins, polyester resins, shellac, polyimide, and rubber. The present filler system finds utility in all abrasive product types, i.e. cut-off, snagging, portable, coated abrasives, and the like, as well as in all grades of grinding wheels be they of the hot-pressed or cold pressed type.

The filler system of the present invention must be present in the bond in an amount of at least about 5% by volume of the total bond i.e. of the total of resin and filler, otherwise the advantage of the filler system will be negligible. At the opposite end of the spectrum the total bond composition must include about 20% by volume of resin or the resulting abrasive product will lack sufficient strength for safe use; thus the upper limit of the present filler system is about 80% by volume of the total of resin and filler. The most effective filler range in the bond is 20–25% by volume.

The relative amounts of iron pyrites, potassium sulfate, and alkali haloferrate based on the total bond i.e. resin and filler, can vary from a minimum amount of pyrites of 2.5% by volume of the bond to a maximum of 40% by volume of the bond; from 1.25% to 20% by volume of potassium sulfate in the bond; and, the alkali haloferrate can vary from a minimum of 1.25% of the bond to a maximum of 20% of the bond, on a volume basis. However, in all cases regardless of whether the total 3 part filler system makes up 5% by volume of the bond or 80% by volume thereof, the ratio of alkali haloferrate-to-pyrites-to-potassium sulfate remains the same viz. 0.5:1:0.5. In other words, if a given wheel specification contains 36% by volume of bond and ¼ (9%) of that is the tripartite filler of the invention, then the alkali haloferrate would be present in an amount of 2.25%, the pyrites 4.50% and the potassium sulfate 2.25%. This relationship holds true regardless of how much total bond is in the wheel, or how much total filler is in the bond. If instead of a bond containing 25% filler as above, the bond contained 40% filler then there would be 10% alkali haloferrate, 20% pyrites and 10% potassium sulfate.

EXAMPLES OF THE PREFERRED EMBODIMENTS

The preferred form of this invention makes use of a combination of abrasive grain and the invention combination of fillers in a conventional phenolic resin bonded cut-off wheel. Such a wheel is a cold pressed 16" diameter by ⅛" thick wheel with the 1" center hole, a typical example being a fused alumina grain that includes 50% 24 grit and 50% 30 grit is mixed with the present fillers bonded by an epoxy modified phenolic resin.

The alkali haloferrates used in mixtures with the iron pyrites and potassium sulfate are preferably $K_2FeCl_4.2KCl+5K_2CO_3$ and $K_2FeCl_3F.2KCl$ either alone or in combination. These filler materials for convenience, will be referred to as KCF5C and TMF respectfully.

The active filler mixture of this invention is blended with the powdered resin composition prior to mixing the bond combination with the abrasive grain in the conventional manner. The filler is present in the resin preferably within a range of from 5% to 60% by volume of the combined resin and filler bonding composition. The iron pyrites, potassium sulfate, and alkali metal haloferrate filler are prepared in powdered form finer in size than the grit size of the abrasive grain, as is conventional, and the iron pyrites, potassium sulfate, and either $K_2FeCl_4$. $2KCl+5\%$ $K_2CO_3$ or $K_2FeClF.2KCl$ or mixtures thereof are blended together preferably in equal volumetric amounts. The preblended fillers are then mixed with the powdered resin, and this batched bond is then mixed with the abrasive grain using conventional pick-up and dampening agents.

To form the wheel, the abrasive grain and batched bond, i.e. filler and resin mix, is measured into an approximately 16"×⅛"×1" steel mold set-up for pressing a cut-off wheel at 600 tons of total force. The pressed wheel shape is then cured in an oven at a temperature of 175° C. following known resinoid bonded wheel manufacturing procedures.

A number of 16"×⅛"×1" cut-off wheels were made in accordance with the above described conventional wheel molding and firing method wherein powdered filler was mixed with the resin bond material, the filler system including iron pyrites and potassium sulfate with either KCF5C ($K_2FeCl_4.2KCl+5\%$ $K_2CO_3$) or TMF ($K_2FeCl_3F.2KCl$). The wheels were made with fused crushed $Al_2O_3$ abrasive which was a mixture of 50% 24 U.S. Standard mesh and 50% 30 U.S. Standard mesh bonded in conventional epoxy modified phenolic resin bond having the fillers mixed therewith. Wheels were made with 4.5% $FeS_2$ mixed with 4.5% $K_2SO_4$ as the filler as a standard for comparison. Additional sets of wheels were made with 9% KCF5C; 4.5% $FeS_2$ and 4.5% KCF5C; 4.5% $FeS_2$ and 4.5% TMF; 4.5% $FeS_2$, 2.25% $K_2SO_4$ and 2.25% TMF; and, 4.5% $FeS_2$, 2.25% $K_2SO_4$ and 2.25% KCF5C. These various cut-off wheels were designated numbers 1, 2, 3, 4, 5, and 6, respectively, and were then used for comparison testing. The composition of these respective test wheels and the data recorded is set forth in the following tables.

TABLE I

| Volumetric Composition of Cut-off Wheels | | | | |
|---|---|---|---|---|
| Wheel No. | Abrasive | Phenolic Resin* | Filler | Porosity |
| 1 | 50% | 27% | 4.5% $FeS_2$-<br>4.5% $K_2SO_4$ | 14% |
| 2 | 50% | 27% | 9% KCF5C | 14% |
| 3 | 50% | 27% | 4.5% $FeS_2$ -<br>4.5% KCF5C | 14% |
| 4 | 50% | 27% | 4.5% $FeS_2$ -<br>4.5% TMF | 14% |
| 5 | 50% | 27% | 4.5% $FeS_2$<br>2.25% $K_2SO_4$<br>2.25% KCF5C | 14% |
| 6 | 50% | 27% | 4.5% $FeS_2$<br>2.25% $K_2SO_4$<br>2.25% TMF | 14% |

*18% of total resin is liquid phenolic resin.

Powdered resin is phenolic modified with epoxy.

These six different sets of test wheels were used for cutting metal and for this purpose were mounted on a Stone M150 hydraulic cut-off machine and were tested cutting 1½" O C1018 cold rolled steel bars and 1½" ϕ 304 stainless steel bars. Test runs were made of 2.5, 3.0, 4.0, 5.0, and 6.0 seconds to complete the cut through the bar and the following data were recorded for different cutting-off times:

TABLE II

Cut-Off Grinding Results on 1½" Ø C1018 Steel

Wheel Size: 16 × ⅛ × 1"
Wheel Speed: 12,000 sfpm
No. of Cuts: 30 cuts each wheel

| Wheel No. | Filler | (Sec.) Time/Cut | (KW) Avg. Peak Cutting Power | G-Ratio* | % Workpiece Burn |
|---|---|---|---|---|---|
| 1 | $FeS_2/K_2SO4$ | 2.5 | 19.6 | 2.74 | 0 |
| 2 | KCF5C | 2.5 | 22.3 | 1.86 | 0–10% |
| 3 | $FeS_2$/KCF5C | 2.5 | 20.0 | 3.18 | 0–10% |
| 4 | $FeS_2$/TMF | 2.5 | 18.9 | 2.95 | 0 |
| 1 | $FeS_2/K_2SO_4$ | 3.0 | 16.7 | 3.71 | 0 |
| 2 | KCF5C | 3.0 | 17.6 | 1.99 | 0–10% |
| 3 | $FeS_2$/KCF5C | 3.0 | 16.7 | 3.28 | 0 |
| 4 | $FeS_2$TMF | 3.0 | 16.3 | 3.11 | 0 |
| 1 | $FeS_2/K_2SO_4$ | 4.0 | 13.2–25.2 | 4.33 (20 cuts) | 0–80% |
| 2 | KCF5C | 4.0 | 13.6 | 2.35 | 0–20% |
| 3 | $FeS_2$/KCF5C | 4.0 | 12.8 | 4.11 | 0 |
| 4 | $FeS_2$/TMF | 4.0 | 12.8 | 3.71 | 0 |

*Area of metal cut-in$^2$.
Area of wheel wear-in$^2$.

TABLE III

Cut-off Grinding Results on 1½" Ø 304 Stainless Steel

Wheel Size - 16 × ⅛ × 1"
Wheel Speed - 12000 sfpm
No. of Cuts - 20 cuts each wheel (2 Wheels/item)

| Wheel No. | Filler | (Sec.) Time/Cut | (KW) Avg. Peak Cutting Power | G-Ratio* | % Workpiece Burn |
|---|---|---|---|---|---|
| 1 | $FeS_2/K_2SO_4$ | 2.5 | 18.0 | 3.68 | 0 |
| | | 2.5 | 17.6 | 3.69 | 0 |
| | | Avg. | 17.8 | 3.68 | |
| 2 | KCF5C | 2.5 | 17.2 | 2.47 | 0 |
| | | 2.5 | 16.8 | 2.55 | 0 |

TABLE III-continued

Cut-off Grinding Results on 1½" Ø 304 Stainless Steel

| | | | | | |
|---|---|---|---|---|---|
| | | | 17.0 | 2.51 | |
| 3 | $FeS_2$/KCF5C | 2.5 | 17.0 | 3.87 | 0 |
| | | 2.5 | 17.6 | 4.33 | 0 |
| | | | 17.3 | 4.10 | |
| 4 | $FeS_2$/TMF | 2.5 | 16.8 | 4.10 | 0 |
| | | 2.5 | 17.2 | 3.88 | 0 |
| | | | 17.0 | 3.99 | |
| 1 | $FeS_2/K_2SO_4$ | 4.0 | 12.6 | 4.44 | 0 |
| | | 4.0 | 12.0 | 4.20 | 0 |
| | | | 12.3 | 4.32 | |
| 2 | KCF5C | 4.0 | 11.2 | 3.08 | 0 |
| | | 4.0 | 11.6 | 3.20 | 0 |
| | | | 11.4 | 3.14 | |
| 3 | $FeS_2$/KCF5C | 2.5 | 12.0 | 5.01 | 0 |
| | | 4.0 | 12.0 | 4.70 | 0 |
| | | | 12.0 | 4.86 | |
| 4 | $FeS_2$/TMF | 4.0 | 11.8 | 4.20 | 0 |
| | | 4.0 | 11.6 | 4.20 | 0 |
| | | | 11.7 | 4.20 | |
| 1 | $FeS_2/K_2SO_4$ | 6.0 | 8.4 | 6.42 | 0 |
| | | | 8.8 | 6.43 | 0 |
| | | | 8.6 | 6.42 | |
| 2 | KCF5C | 6.0 | 8.0 | 3.19 | 0 |
| | | 6.0 | 8.0 | 4.39 | 0 |
| | | | 8.0 | 3.79 | |
| 3 | $FeS_2$/KCF5C | 6.0 | 8.8 | 5.12 | 0–10% |
| | | 6.0 | 8.2 | 6.97 | 0 |
| | | | 8.5 | 6.04 | |
| 4 | $FeS_2$/TMF | 6.0 | 8.8 | 5.15 | 0 |
| | | 6.0 | 8.0 | 7.70 | 0–10% |
| | | | 8.4 | 6.42 | |

* $\frac{\text{Area of metal cut-in}^2}{\text{Area of wheel-in}^2}$

TABLE IV

Cut-off Grinding Results on 1½" Ø 304 Stainless Steel

Wheel Size: 16 × ⅛ × 1
Wheel Speed: 12,000 SFPM
No. of Cuts: 20 cuts each wheel (2 Wheels/item)

| Wheel No. | Filler | Time/Cut | (KW) Avg. Peak Cutting Power | G-Ratio* | % Workpiece Burn |
|---|---|---|---|---|---|
| 1 | $FeS_2/K_2SO_4$ | 2.5 | 18.0 | 4.24 | 0 |
| | | | 18.4 | 4.24 | 0 |
| | | | Avg. 18.2 | 4.24 | |
| 5 | $FeS_2/K_2SO_4$/ KCF5C | 2.5 | 18.0 | 4.80 | 0 |
| | | | 18.4 | 4.23 | 0 |

TABLE IV-continued

| | | | | | |
|---|---|---|---|---|---|
| | | | Avg. 18.2 | 4.51 | |
| 1 | $FeS_2/K_2SO_4$ | 4.0 | 12.6 | 4.33 | 0 |
| | | | 13.6 | 4.90 | 0–10% |
| | | | Avg. 13.1 | 4.62 | |
| 5 | $FeS_2/K_2SO_4$/ KCF5C | 4.0 | 11.6 | 4.59 | 0 |
| | | | 12.0 | 4.69 | 0 |
| | | | Avg. 11.8 | 4.74 | |
| 1 | $FeS_2/K_2SO_4$ | 6.0 | 9.6 | 5.37 | 0–20% |
| | | | 10.4 | 4.69 | 0–30% |
| | | | Avg. 10.0 | 5.03 | |
| 5 | $FeS_2/K_2SO_4$/ KCF5C | 6.0 | 9.0 | 5.75 | 0–10% |
| | | | 9.6 | 4.99 | 0–20% |
| | | | Avg. 9.3 | 5.37 | |
| 1 | $FeS_2/K_2SO_4$ | 2.5 | 17.6 | 3.38 | 0 |
| | | | 17.6 | 3.23 | |
| | | | Avg. 17.6 | 3.30 | |
| 6 | $FeS_2/K_2SO_4$/ | 2.5 | 17.6 | 3.94 | 0 |
| | | | 17.6 | 3.55 | 0 |
| | | | Avg. 17.6 | 3.74 | |
| 1 | $FeS_2/K_2SO_4$ | 4.0 | 12.0 | 4.28 | 0 |
| | | | 12.6 | 3.65 | 0 |
| | | | Avg. 12.3 | 3.97 | |
| 6 | $FeS_2/K_2SO_4$/ TMF | 4.0 | 11.6 | 5.17 | 0 |
| | | | 12.0 | 4.27 | 0 |
| | | | Avg. 11.8 | 4.72 | |
| 1 | $FeS_2K_2SO_4$ | 6.0 | 8.8 | 4.65 | 0–20% |
| | | | 9.2 | 4.67 | 0–10% |
| | | | Avg. 9.0 | 4.66 | |
| 6 | $FeS_2/K_2SO_4$/ TMF | 6.0 | 8.8 | 4.61 | 0 |
| | | | 8.8 | 4.64 | 0–20% |
| | | | Avg. 8.8 | 4.62 | |

* $\frac{\text{Area of Metal cut-in}^2}{\text{Area of Wheel wear-in}^2}$ at the faster rates but a 0–80% burn at the slower 4.0 second cut.

On the other hand, wheels #3 that included $FeS_2$ and KCF5C filler together, produced an improved cutting action. At the faster cutting speed where the chopping off was completed in 2.5 seconds, evidence of very minor burn was seen. However, at the slower cut-off speed of 3.0 and 4.0 seconds, no burn was evident.

Wheels #4, using $FeS_2$ and TMF, used less average power with no burn being evident on the steel bars in any of its test cuts. This combination of fillers and amounts thereof also produced wheels having a higher grinding ratio (G-Ratio) than the conventional wheels with which they were compared, in the case of the 2.5 second cuts.

Additional comparative testing was made with these cut-off wheels by cutting 1½" rod of ϕ304 stainless steel, these data being recorded in Table III. These cuts were made at 2.5, 4.0 and 6.0 seconds to complete the cut, with the results that showed the wheels with the $FeS_2$/KCF5C or $FeS_2$/TMF filler combinations either used less peak power i.e. KW per cut, or had a higher grinding ratio as a result of the cutting action as compared with the standard wheels.

Similarly, Tables IV and V show the results of comparative tests between the standard filler $FeS_2/K_2SO_4$ and wheels wherein the bonds contained $FeS_2/K_2SO_4$/TMF or $FeS_2/K_2SO_4$/KCF5C. In all cases the wheels containing the invention filler exhibited higher G-Ratios, and when the cutting conditions were the most severe, the invention's wheels caused substantially less burn on the work piece.

TABLE V

Cut-off Grinding Results on 1½ ∅ C1018 Steel

Wheel Size: 16 × ⅛ × 1"
Wheel Speed: 12,000 SFPM
No. of Cuts: 30 cuts each wheel

| Wheel No. | Filler | (Sec.) Time/Cut | Avg. Peak (KW) Cutting Power | G Ratio* | % Workpiece Burn |
|---|---|---|---|---|---|
| 1 | $FeS_2/K_2SO_4$ | 2.5 | 20.4 | 4.03 | 0 |
| 5 | $FeS_2/K_2SO_4$/KCF5C | 2.5 | 20.8 | 3.63 | 0 |
| 1 | $FeS_2/K_2SO_4$ | 3.0 | 17.6 | 3.89 | 0 |
| 5 | $FeS_2/K_2SO_4$/KCF5C | 3.0 | 17.1 | 3.63 | 0 |
| 1 | $FeS_2/K_2SO_4$ | 4.0 | 13.6–20.0 | 4.52 | 0–80% |
| 5 | $FeS_2/K_2SO_4$/KCF5C | 4.0 | 13.6 | 4.52 | 0–20% |
| 1 | $FeS_2/K_2SO_4$ | 2.5 | 20.0 | 2.91 | 0 |
| 6 | $FeS_2/K_2SO_4$/TMF | 2.5 | 19.2 | 3.07 | 0 |
| 1 | $FeS_2/K_2SO_4$ | 3.0 | 16.8 | 3.16 | 0 |
| 6 | $FeS_2/K_2SO_4$/TMF | 3.0 | 16.4 | 3.57 | 0 |
| 1 | $FeS_2/K_2SO_4$ | 4.0 | 13.6 | 3.82 | 0–10% |
| 6 | $FeS_2/K_2SO_4$/TMF | 4.0 | 12.8 | 3.57 | 0 |
| 1 | $FeS_2/K_2SO_4$ | 5.0 | 12.8–20.8 | 3.21 | 0–100% |
| 6 | $FeS_2/K_2SO_4$/TMF | 5.0 | 10.8 | 3.49 | 0–10% |

* $\frac{\text{Area of metal Cut-in}^2}{\text{Area of Wheel wear-in}^2}$

Referring to the results recorded in Table II, it will be observed that KCF5C used alone in wheels identified as #2 at all of the test cutting rates, does not produce wheels which perform as well as wheels perform containing the conventional $FeS_2/K_2SO_4$ grinding aid used in the control wheels #1. Wheels #1 had a longer apparent life after 30 cuts and a higher grinding ratio (G-Ratio) as compared with wheels #2. Wheels #2 in this test, caused an estimated 0–10% burn during the 2.5 second and 3.0 second cuts, to as much as 20% on the steel bar during the 4 second cutting test. The control wheel was operated under the same test conditions without producing any visual burning of the cut metal Another series of wheels, according to the invention, were made and tested in the same manner as those set out above. The difference here was the total filler level which was 43.2% by volume of the bond (20.2% by volume of the wheel) as compared to 25% by volume of the bond (8–10% by volume of the wheel) for the sets of wheels described above. These wheels had a volume percent composition of:

| | Vol. % |
|---|---|
| abrasive | 44.7 |
| resin | 26.6 |
| filler | 20.2 |

-continued

| | Vol. % |
|---|---|
| plasticizer | 5.0 |
| porosity | 3.5 |

The invention wheels and the standard $FeS_2$-$K_2SO_4$ filler wheels had the following volume compositions:

| | Wheel No. 1 | Wheel No. 2 |
|---|---|---|
| abrasive | 44.7 | 44.7 |
| phenolic resin | 26.6 | 26.6 |
| filler | | |
| ($FeS_2$) | 10.1 | 10.1 |
| ($K_2SO_4$) | 10.1 | 5.05 |
| (TMF) | — | 5.05 |
| plasticizer | 5.0 | 5.0 |
| porosity | 3.5 | 3.5 |

The grinding results with these wheels cutting 1.5" 304 stainless steel and C1018 carbon steel were as follows:

TABLE VI

Cut-Off Grinding Results on 1½" Ø 304 Stainless Steel

Wheel Size: 16 × ⅛ × 1"
Wheel Speed: 12,000 sfpm
No. of Cuts: 30 cuts each wheel (2 wheels/item)

| Wheel No. | Filler | (Sec.) Time/Cut | (KW) Avg. Peak Cutting Power | G-Ratio* | % Workpiece Burn |
|---|---|---|---|---|---|
| 1 | $FeS_2/K_2SO4$ | 2.5 | 17.6 | 5.14 | 0 |
| | | | 18.0 | 5.40 | 0 |
| | | | 17.8 | 5.26 | |
| 2 | $FeS_2/K_2SO_4$/TMF | 2.5 | 17.6 | 5.99 | 0 |
| | | | 17.6 | 5.40 | 0 |
| | | | 17.6 | 5.70 | |
| 1 | $FeS_2/K_2SO_4$ | 4.0 | 12.3 | 6.72 | 0 |
| | | | 12.4 | 6.32 | 0 |
| | | | 12.4 | 6.52 | |
| 2 | $FeS_2/K_2SO_4$/TMF | 4.0 | 12.0 | 8.27 | 0 |
| | | | 12.0 | 8.95 | 0 |
| | | | 12.0 | 8.61 | |

TABLE VII

Cut-Off Grinding Results on 1½" Ø C1018 Carbon Steel

Wheel Size: 16 × ⅛ × 1"
Wheel Speed: 12,000 sfpm
No. of Cuts: 30 cuts each wheel (2 wheels/item)

| Wheel No. | Filler | (Sec.) Time/Cut | (KW) Avg. Peak Cutting Power | G-Ratio* | % Workpiece Burn |
|---|---|---|---|---|---|
| 1 | $FeS_2/K_2SO_4$ | 2.5 | 19.6 | 5.67 | 0 |
| 2 | $FeS_2/K_2SO_4$/TMF | 2.5 | 19.6 | 5.68 | 0 |
| 1 | $FeS_2/K_2SO_4$ | 3.0 | 17.6 | 6.34 | 0 |
| 2 | $FeS_2/K_2SO_4$/TMF | 3.0 | 16.4 | 6.34 | 0 |
| 1 | $FeS_2/K_2SO_4$ | 4.0 | 20.8 | 6.72 | 100% (Heavy Burn) |
| 2 | $FeS_2/K_2SO_4$/TMF | 4.0 | 13.2 | 6.34 | 0–10% (Good Cut) |

In general, the combination of $FeS_2$ alone or in combination with $K_2SO_4$, with the higher amounts of KCF5C or TMF produces wheels with overall improved grinding properties. Use of this combination and amounts of fillers serves to increase the grinding ratio over what can be realized from the use of any of these fillers alone in wheels; less power is used to complete the cut and with less burning of the metal being cut, when these grinding aids are used at their optimum cutting speeds.

The preferred form of this invention has been described above, it is possible that modifications thereof may occur to those skilled in the art which will fall within the scope of the following claims.

What is claimed is:

1. An organic polymer bonded abrasive product comprising abrasive grain, an organic polymer for said abrasive grain, and active fillers which together with the organic polymer comprise a bond, wherein the improvement comprises an active filler which is a mixture of iron pyrites, potassium sulfate, and an alkali metal haloferrate having the formula:

$$A_xFe_y{+}{+}Fe_z{+}{+}{+}H_{x+2Y+3z}$$

in which A is an alkali metal ion or ammonium ion, H is a halide ion, x is a number from 1 to 10, y is a number from 0 to 1, z is a number from 0 to 1, and y and z cannot be 0 at the same time, the fillers are present in said bond in a ratio of alkali haloferrate-to-pyrites-to-potassium sulfate of 0.5:1:0.5, and said fillers are present in said bond in a total amount of from 5 to 80% by volume.

2. The abrasive product of claim 1 wherein said iron pyrites is present in an amount of 2.5% to 40% by volume of the bond, said potassium sulfate is present in an amount of 1.25 to 20% by volume of the bond, and said $A_xFe_y{+}{+}Fe_z{+}{+}{+}H_{x+2y+3z}$ is present in an amount of 1.25% to 20% by volume of the bond.

3. The abrasive product of claim 2 wherein said alkali metal haloferrate is one selected from the group consisting of $KFeCl_3$, $K_2FeCl_4$, $K_2FeCl_42KCl$, $KFeF_3$, $FeCl_2$, $K_2FeCl_3F$, $K_2FeCl_3F2KCl$, $K_2FeCl_42KCl+5\%$ $K_2CO_3$, and mixtures thereof.

4. The abrasive product of claim 1 wherein said abrasive product is a grinding wheel.

5. The abrasive product of claim 1 wherein said abrasive product is a coated abrasive product.

6. The abrasive product of claim 1 wherein said filler combination is present in the bond in a total amount of 20% to 50% by volume.

* * * * *